US006427373B1

(12) United States Patent
Schuemann

(10) Patent No.: US 6,427,373 B1
(45) Date of Patent: Aug. 6, 2002

(54) GUN BARREL RIFLING

(76) Inventor: Wil Schuemann, P.O. Box 248, Bingen, WA (US) 98605

( * ) Notice: Subject to any disclaimer, the term of this patent is extended or adjusted under 35 U.S.C. 154(b) by 0 days.

(21) Appl. No.: 09/571,151

(22) Filed: May 16, 2000

Related U.S. Application Data

(60) Provisional application No. 60/135,294, filed on May 21, 1999.

(51) Int. Cl.[7] ..... F41A 21/00
(52) U.S. Cl. ..... 42/78
(58) Field of Search ..... 42/78, 76.01; 89/14.05

(56) References Cited

U.S. PATENT DOCUMENTS

| | | | | | |
|---|---|---|---|---|---|
| 300,515 | A | | 6/1884 | Schneider | |
| 329,303 | A | | 10/1885 | Fosbery | |
| 460,102 | A | * | 9/1891 | Carver | 42/78 |
| 835,482 | A | | 11/1906 | Vulpius | |
| 868,938 | A | | 10/1907 | Puff | |
| 1,315,504 | A | | 9/1919 | Humm | |
| 1,355,421 | A | | 10/1920 | Pedersen | |
| 1,355,422 | A | | 10/1920 | Pedersen | |
| 1,659,625 | A | | 2/1928 | Cowan | |
| 1,944,883 | A | * | 1/1934 | Gerlich | 42/76 |
| 2,089,219 | A | * | 8/1937 | Moore | 42/78 |
| 2,345,089 | A | * | 3/1944 | Born | 42/76 |
| 2,967,369 | A | | 1/1961 | Musser | 42/78 |
| 3,562,945 | A | | 2/1971 | Mikola | 42/78 |
| 3,616,562 | A | | 11/1971 | Burgsmuller | 42/78 |
| 4,008,538 | A | | 2/1977 | Center | 42/78 |
| 4,175,346 | A | | 11/1979 | Zemsky | 42/76 R |
| 4,308,681 | A | | 1/1982 | Gorman | 42/78 |
| 4,527,348 | A | * | 7/1985 | Brennan | 42/76 |
| D388,192 | S | | 12/1997 | Rubin | |

* cited by examiner

*Primary Examiner*—Michael J. Carone
*Assistant Examiner*—M Thomson
(74) *Attorney, Agent, or Firm*—Cahill, Sutton & Thomas P.L.C.

(57) ABSTRACT

The rifling in a barrel of a firearm is modified in proximity to the muzzle to reduce the radial difference between the land diameter and the groove diameter to urge a bullet to expand fully into the grooves and ensure rotation of the bullet about its longitudinal axis and without any lateral velocity component. Preferably, the land diameter is increased to a diameter somewhat less than the groove diameter but in the alternative the groove diameter may be reduced to a diameter somewhat more than the land diameter.

8 Claims, 2 Drawing Sheets

GUN BARREL RIFLING

The present invention claims priority to the subject matter disclosed in a provisional application entitled "GUN BARREL RIFLING" filed May 21, 1999 and assigned Ser. No. 60/135,294 directed to an invention made by the present inventor.

BACKGROUND OF THE INVENTION

1. Field of the Invention

The present invention relates to gun barrel rifling and, more particularly, to rifling having a varying radial spacing between the surface of the lands and the bottom surfaces of the interleaved grooves as a function of distance along the barrel.

2. Description of Related Art

A conventional gun barrel of a firearm includes a bore having rifling formed therein. That is, the rifling usually includes a plurality of helical, sometimes referred to as spiral, radially inwardly facing lands with interleaved grooves. The surfaces of these lands are usually arcuate corresponding in curvature with the respective radius from the axis of the bore. Other configurations of the surfaces of the lands are known. Each of the grooves usually includes a bottom surface also arcuate as a function of the radius from the axis of the bore. Other configurations for the bottom surfaces of the grooves are known. Generally, the sides interconnecting the lands with the bottom surfaces of the grooves are essentially radially aligned. However, other surface configurations interconnecting the lands with the bottom surfaces of the grooves are known.

Typically, six lands and corresponding six grooves are equiangularly displaced about the bore of the barrel. For purposes of terminology, the term land diameter means the distance from one land to a radially opposing land. The groove diameter is the distance from the bottom surface of one groove to the bottom surface of a radially opposing groove. The diameter (caliber) of the projectile or bullet fired through a barrel usually corresponds with the groove diameter. To define the distance between the surface of a land and the longitudinal axis of the bore and the distance between the bottom surface of a groove and the longitudinal axis of the bore, the terms land radius and groove radius, respectively, may be used.

As a firearm is discharged, the gases generated within the casing propel or fire the bullet through the barrel. Because the land diameter is less than the diameter of the usually cylindrical part of the bullet, the lands will engrave corresponding channels in the bullet. As the bullet travels toward the muzzle, the channels interacting with the respective lands, will cause the bullet to rotate about its longitudinal axis at a rate commensurate with the helix (or spiral) of the lands and the velocity/acceleration of the bullet traveling through the bore of the barrel.

Upon close inspection of bullets fired through a barrel, it has been learned that the grooves formed in the bullet by the respective lands are often not of the same uniform depth. Such lack of uniformity of depth suggests that the longitudinal axis of the bullet is not coincident with the longitudinal axis of the bore of the barrel. Without such coincidence, the bullet will be laterally displaced as it is longitudinally displaced during its travel through the bore. Assuming that the center of gravity of the bullet is located on its longitudinal axis, the asymmetric depth of the grooves in the bullet will cause the center of gravity of the bullet to move in a helix (spiral) as the bullet translates through the bore. Upon discharge of the bullet from the muzzle, the spinning motion of the bullet will have a lateral velocity component of some degree. Such lateral velocity component will result in inaccuracy of travel as a function of the degree of lateral velocity component present. As it is unlikely that any two consecutively fired bullets will have exactly the same degree of lateral velocity component, different paths or trajectories will be followed by each bullet. Such different trajectories will result in non-correspondence of the bullets striking the same point on a target, assuming all other variables of windage, etc. being constant.

SUMMARY OF THE INVENTION

As a projectile or bullet begins to travel down the bore of a gun barrel upon discharge of a firearm, a plurality of the lands tapering radially inwardly engrave or form channels in the bullet to guide the bullet and cause it to spin as a function of the helix (or spiral) of the rifling. The pressure of the gases behind the bullet in combination with the resistance to forward travel of the bullet induced by the lands of the rifling, as well as the inertia of the bullet, causes the material of the bullet to expand radially to a greater or lesser degree into the grooves interleaving the lands. Toward the muzzle of the barrel, the ratio of the land diameter to the groove diameter is increased to induce the material of the bullet to come into uniform contact with the bottom surface of each of the grooves to centralize the bullet within the bore and to ensure that the spin of the bullet is essentially about its longitudinal axis and hence about the center of gravity of the bullet to minimize or eliminate any lateral velocity component of the bullet. To increase the ratio of the land diameter to the groove diameter, the lands may taper radially outwardly toward the bore surface, and hence toward the bottom surface of the grooves, or the bore may be reduced to bring the groove diameter toward the land diameter.

It is therefore a primary object of the present invention to reduce any lateral velocity component of a projectile as it translates through the rifling in a barrel of a firearm.

Another object of the present invention is to induce the material of a projectile traveling through a rifled bore to become supported by the bottom surfaces of the grooves interleaving the lands in the bore.

Still another object of the present invention is to increase the ratio of the land diameter to the groove diameter toward the muzzle of a rifled barrel of a firearm.

A further object of the present invention is to provide varying depth grooves in a rifled barrel of a firearm to urge a projectile discharged from the barrel to spin about its longitudinal axis and without any lateral velocity component.

A still further object of the present invention is to provide a rifled barrel of a firearm having an increased land diameter in proximity to the muzzle.

A yet further object of the present invention is to provide a rifled barrel of a firearm having a reduced groove diameter in proximity to the muzzle.

A yet further object of the present invention is to provide a method for reducing the lateral velocity component of a projectile traveling through the barrel rifling of a firearm.

These and other objects of the present invention will become apparent to the those skilled in the art as a description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
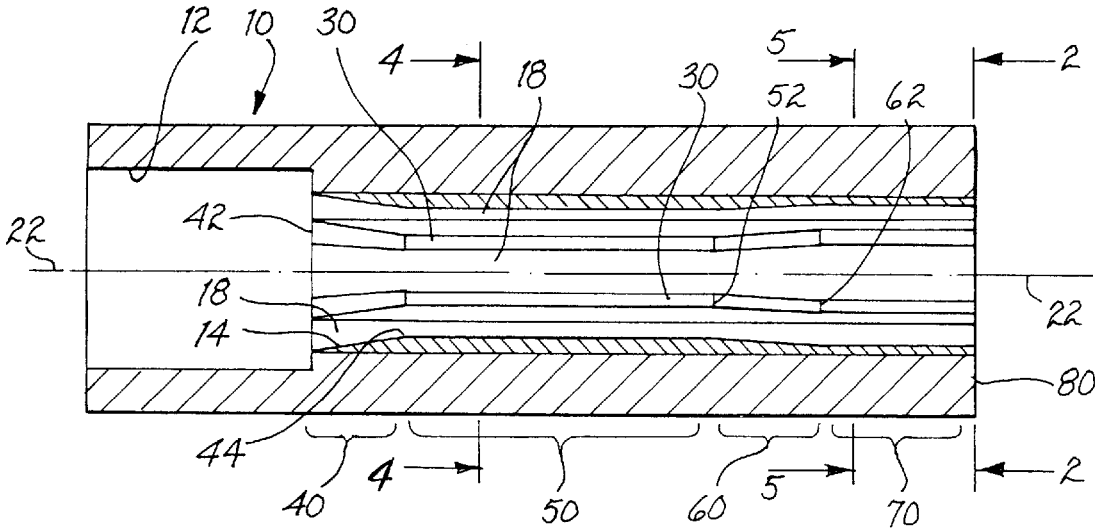
FIG. 1 illustrates a cross-section of a rifled bore of a firearm and wherein the lands and grooves are shown straight, instead of helically or spirally configured, for purpose of clarity.
Figure 2:
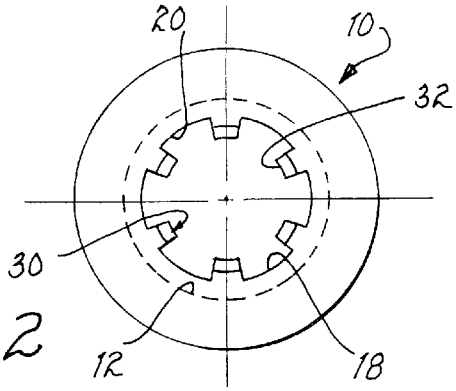
FIG. 2 is a end view taken along lines 2—2 as shown in FIG. 1.
Figure 3:
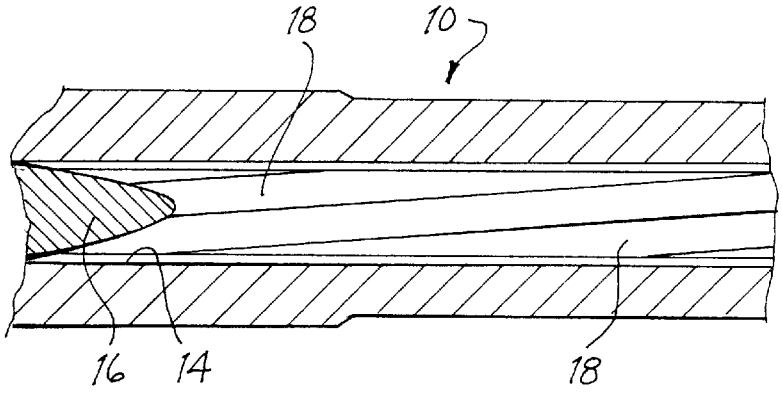
FIG. 3 is a representative cross-sectional view illustrating the barrel rifling actually present in FIG. 1.

Referring to FIG. 1, there is shown a barrel 10 of a firearm, which may be a handgun, a rifle, or other ordinance. The barrel includes a chamber 12 representatively shown for receiving a cartridge supporting a projectile or bullet. The chamber is in communication with bore 14 of the barrel, which bore is essentially identical with the caliber of bullet 16 (see FIG. 3). A plurality of grooves 18 (opposed pairs or an odd number) are cut helically (sometimes referred to as spiral grooves) in the barrel, as shown in FIG. 3 to form the rifling in the barrel. Bottom surface 20 (see FIG. 2) of each of these grooves is essentially arcuate with a curvature as a function of the radial distance from longitudinal axis 22 of the bore and essentially define the bore of the barrel. As discussed above, the term groove diameter defines the distance between opposed pairs of grooves and the term groove radius defines the distance between the bottom surface of a groove and the axis of the bore.

Interleaved between adjacent grooves 18 are lands 30. These lands (opposed pairs or an odd number) extend radially inwardly toward longitudinal axis 22 of the bore and are terminated by land surfaces 32 (see FIG. 2). The land surface may be flat or curved with a curvature being commensurate with the radial distance between the longitudinal axis of the bore and the land surface. The term land diameter, as discussed above, corresponds with the distance between opposed pairs of land surfaces and the term land radius defines the distance between the land surface and the longitudinal axis of the bore.

As particularly shown in FIG. 1, bore 14 includes essentially four sections. The first section adjacent chamber 12 is referred to as engraving section 40. In the engraving section, the radial inward protrusion of lands 30 increases from a point 42 essentially coincident with the surface of the proximal end of bore 14 or distally therefrom to a point 44 of minimal land diameter distally therefrom. Normal section 50 extends distally from point 44 to a point 52 and is essentially of conventional rifling. Beginning at about point 52, transition section 60 begins. In transition section 60, the land diameter increases from point 52 to point 62 located distally therefrom. In terminal section 70 the land diameter is essentially constant to muzzle 80.

Figure 4:
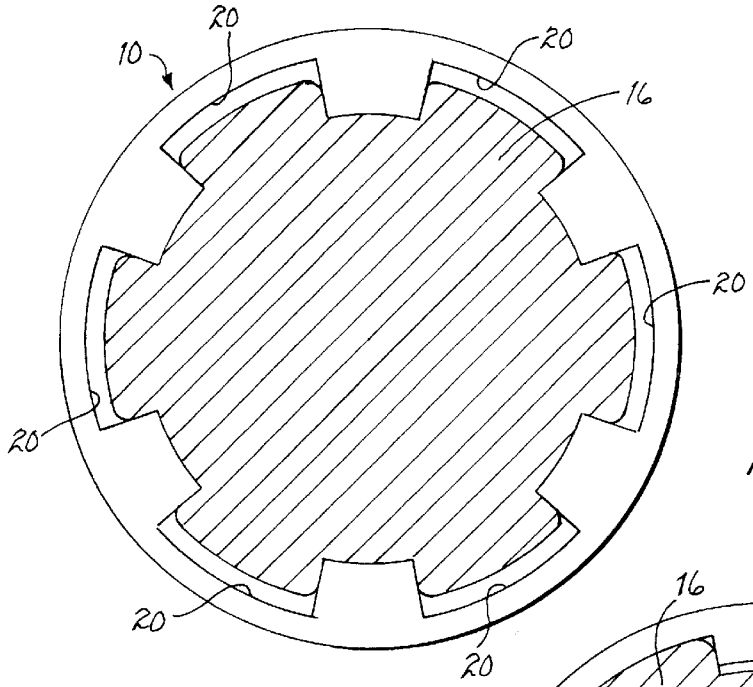
FIG. 4 is a cross-sectional view taken along lines 4—4, as shown in FIG. 1.

When the firearm is discharged, bullet 16 being partially in engraving section 40 will travel therethrough and lands 30 will cut, form or engrave commensurately configured channels in the bullet. Simultaneously, the bullet will tend to expand radially due to the pressure of gases therebehind, inertia, and the resistance to forward movement caused by the rifling in the barrel. Such expansion will cause segments of the bullet to extend into grooves 18, as illustrated in FIG. 4. Although bullet 16 appears in FIG. 4 to be centered in the bore of barrel 10, such is not usually the case, especially when engraving jacketed bullets. The above discussion is primarily pertinent to lead bullets. Jacketed bullets tend to become extruded longitudinally and may decrease somewhat in diameter when engraved.

A bullet is typically larger than the groove diameter but smaller than the free bore, if present. As the bullet enters engraving section 40, some of the lands will cut, form or engrave the bullet to a deeper extent than other lands. This will result in the longitudinal axis of the bullet being off-center from longitudinal axis 22 of bore 14. Since the longitudinal axis of the bullet passes through the center of gravity of the bullet, the center of gravity of the bullet will travel in a helical (spiral) pattern about the longitudinal axis of the bore. Such helical (spiral) travel creates a lateral velocity component to the forward motion of the bullet. Upon discharge of the bullet from muzzle 80, the lateral component of force will act upon the bullet and affect its trajectory. As particularly shown in FIG. 4, bullet 16 is not laterally expanded sufficiently to ensure contact by the surface of the bullet with each of bottom surfaces 20 of grooves 18. The amount of space therebetween will vary for each bullet and as between bullets discharged through the barrel.

Transition section 60 defines a section of increasing land diameter and therefore a reduction in radial distance between bottom surface 20 of each groove 18 and land surface 32 of each land 30, the ratio of land diameter (radius) to groove diameter (radius) will increase. Such reduced difference urges bullet 16 to expand radially until each of grooves 20 is essentially filled and the bullet bears uniformly against each of bottom surfaces 20 (see FIG. 5). The resulting complete or essentially complete contact by the bullet with each of bottom surfaces 20 ensures that the longitudinal axis of the bullet, and hence its center of gravity, is coincident with longitudinal axis 22 of bore 14. Any lateral velocity component that may have been previously present will become damped and no longer be present as the projectile/bullet passes from transition section 60 into terminal section 70.

In terminal section 70, the land diameters have been increased as a function of transition section 60 but remain constant to muzzle 80 to ensure complete expansion of the bullet into the grooves and damn any preexisting lateral velocity component upon discharge of the bullet. The resulting lack of lateral velocity component will permit the bullet to spin about its longitudinal axis and hence about its center of gravity as a result of the helical (spiral) rifling present in barrel 10.

Figure 5:
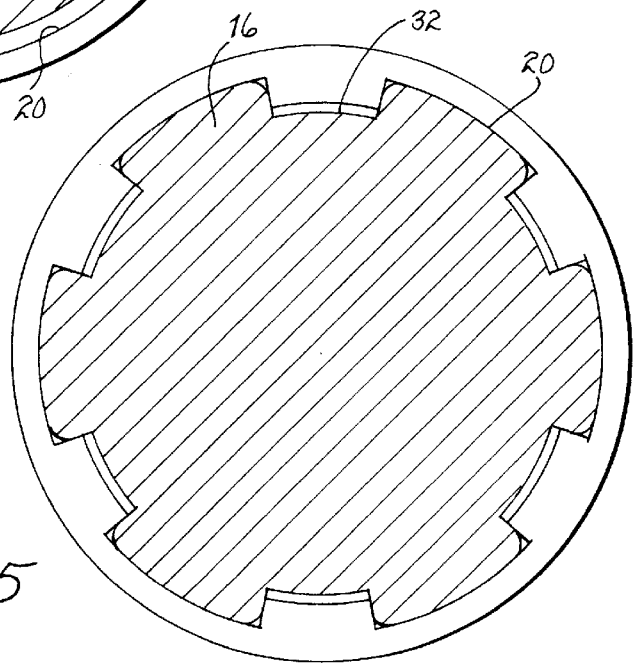
FIG. 5 is a cross-sectional view taken along lines 5—5, as shown in FIG. 1.
Figure 6:
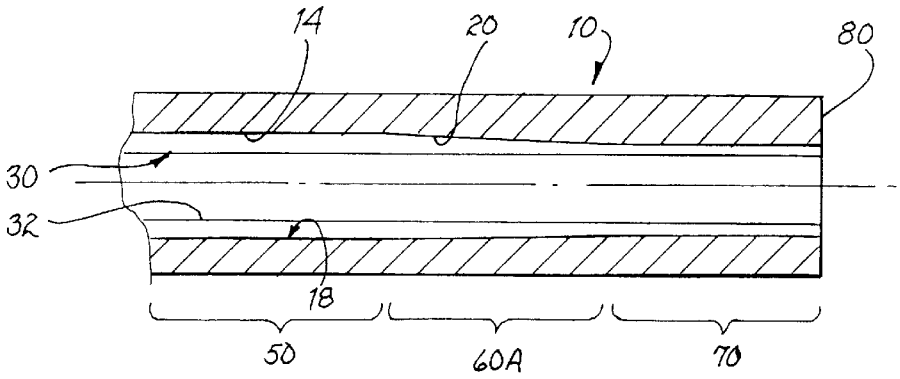
FIG. 6 is a partial view of a barrel depicting a variant of the transition section shown in FIG. 1 and in which the groove diameter is reduced.

As discussed above, expansion of the surface of bullet 16 to fill grooves 18 can be accomplished by increasing the land diameter. A similar result can be achieved by reducing the groove diameter and thereby also reduce the difference between the land diameter and the groove diameter; or, increase the ratio of land diameter to groove diameter. Referring to FIG. 6, there is shown a variant of the bore construction shown in FIG. 1. Transition section 60A includes lands 30 with the land diameter being maintained essentially constant. The groove diameter is progressively decreased by reducing the depth of bottom surface 20 of each of grooves 18. As bullet 16 passes into and through terminal section 70 it will have a configuration as depicted in FIG. 5 and discussed above in detail. Thereby, any lateral velocity component induced in the bullet is damped and eliminated by expansion of the bullet adjacent bottom surfaces 20 of grooves 18 with the resulting benefit of a spinning bullet being essentially unaffected by a lateral velocity component.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. In a firearm barrel having rifling formed by a plurality of lands and interleaved grooves defining the bore of the barrel, said plurality of lands having a variable land diameter as a function of the location of said lands along said barrel, the improvement comprising in combination:

a) an engraving section of said plurality of lands wherein the land diameter decreases toward a muzzle of the barrel;

b) a normal section wherein the land diameter remains constant; and c) a transition section wherein the land diameter increases toward the muzzle of the barrel.

2. The improvement as set forth in claim 1 including a constant section disposed intermediate said transition section and the muzzle of the barrel wherein the increased land diameter remains essentially constant.

3. In a firearm barrel having rifling formed by lands and interleaved grooves defining a bore of said barrel and defining a ratio of the diameter of the lands to the diameter of the grooves, the improvement comprising in combination:

a) an engraving section of said lands and said grooves wherein the ratio of land diameter to groove diameter decreases along said barrel in a direction toward a muzzle of the barrel;

b) a normal section of said lands and said grooves adjacent said engraving section wherein the ratio of land diameter to groove diameter is essentially constant; and c) a transition section of said lands ad said grooves adjacent said normal section wherein the ratio of land diameter to groove diameter increases along said barrel in a direction toward the muzzle of the barrel.

4. The improvement as set forth in claim 3 including a constant section of said lands and said grooves adjacent said transition section wherein the ratio of land diameter to groove diameter is essentially constant.

5. The improvement as set forth in claim 4 wherein the ratio of land diameter to groove diameter is greater in said constant section than in said normal section.

6. A firearm barrel having rifling for urging a projectile having a longitudinal axis and discharged from a muzzle of said barrel to rotate about its longitudinal axis, said barrel comprising in combination:

a) a plurality of lands, each of said lands including a land surface having a land radius;

b) a plurality of grooves interleaved with said plurality or lands defining a bore of said barrel and including bottom surfaces, each of said bottom surfaces having a groove radius;

c) an engraving section wherein the land radii decreases;

d) a normal section disposed toward the muzzle from said engraving section wherein the land radii is constant, e) a transition section disposed toward the muzzle from said normal section wherein the land radii increase to a value less than the value of the groove radii to urge lateral expansion of the projectile into contact with said bottom surfaces; and f) a constant section disposed between said transition section and the muzzle wherein the land radii is constant to further urge lateral expansion of the projectile into contact with said bottom surfaces.

7. The barrel as set forth in claim 6 wherein said plurality of lands include opposed pairs of lands and wherein said plurality of grooves include opposed pairs of grooves.

8. A firearm barrel having rifling for urging a projectile having a longitudinal axis and discharged from a muzzle of said barrel to rotate about its longitudinal axis, said barrel comprising in combination:

a) a plurality of lands disposed in said barrel, each land of said plurality of lands including a land surface having a land radius;

b) a plurality of grooves interleaved with said plurality of lands, each groove of said plurality of grooves including a bottom surface having a groove radius;

c) an engraving section disposed in said barrel wherein the ratio of land diameter to groove diameter decreases to urge formation of channels in the projectile passing therethrough;

d) a constant section disposed in said barrel located adjacent said engraving section wherein said ratio remains essentially constant;

e) a transition section disposed in said barrel adjacent to said constant section wherein a ratio of said land radii to said groove radii increases to urge lateral expansion of the projectile into contact with and receive support from said bottom surfaces; and f) a normal section disposed in said barrel located intermediate said transition section and the muzzle wherein said ratio is essentially constant.

* * * * *